US006941840B1

(12) United States Patent
Harris

(10) Patent No.: US 6,941,840 B1
(45) Date of Patent: Sep. 13, 2005

(54) MULTIPLE NUT TOOL AND METHOD

(76) Inventor: Randall D. Harris, 27 High Point Dr., Gulf Breeze, FL (US) 32561

( * ) Notice: Subject to any disclaimer, the term of this patent is extended or adjusted under 35 U.S.C. 154(b) by 0 days.

(21) Appl. No.: 10/639,666

(22) Filed: Aug. 12, 2003

(51) Int. Cl.[7] ..... B25B 27/00
(52) U.S. Cl. ..... 81/13; 81/55
(58) Field of Search ..... 81/13, 55, 124.4, 81/124.5

(56) References Cited

U.S. PATENT DOCUMENTS 847,768 A * 3/1907 Hartman ..... 81/13
1,337,084 A * 4/1920 Libenschek ..... 81/13
1,830,143 A * 11/1931 Taylor ..... 81/13
2,102,897 A * 12/1937 Holhut ..... 81/13
3,349,650 A * 10/1967 Wright ..... 81/13
3,877,327 A * 4/1975 Erm ..... 81/124.4
4,063,475 A 12/1977 Perkins
4,564,991 A 1/1986 Taylor
5,074,170 A 12/1991 Shirley
5,218,758 A 6/1993 Nguyen
5,499,554 A * 3/1996 Ilyes ..... 81/55
5,865,018 A 2/1999 Wanie
6,253,644 B1 7/2001 Duquette
6,305,245 B1 10/2001 Kress
6,588,303 B1 * 7/2003 Walsh ..... 81/13
6,691,595 B2 * 2/2004 Hsien ..... 81/124.5

* cited by examiner

*Primary Examiner*—James G. Smith
(74) *Attorney, Agent, or Firm*—J. Nevin Shaffer, Jr.

(57) ABSTRACT

A multiple nut tool apparatus and method includes a slide shaft. More than one socket receiver is connected to the slide shaft such that at least one of the socket receiver is movable. A socket adapter is connected to each of the socket receivers.

2 Claims, 4 Drawing Sheets

MULTIPLE NUT TOOL AND METHOD

FIELD OF THE INVENTION

This invention relates to a multiple nut tool and method. In particular, according to one embodiment, the invention relates to a multiple nut tool for enabling the removal of more than one nut from a device at the same time.

BACKGROUND OF THE INVENTION

As anyone knows who has operated machinery, many circumstances arise when more than one pair of hands is necessary or useful when the time comes time to work on the machinery. For example only, and not by limitation, it is often necessary to remove the cutting blades from lawn mowers, large or small. In particular, commercial, walk-behind, self-propelled lawn mowers with multiple blades are particularly difficult to work on. These types of mowers typically have more than one blade. For one person to remove these double or triple blades is a difficult and time consuming operation. The blades are held in place by a single long bolt with a large nut. In the past, a person would hold one nut in place, lift the mower for access to the bolt and remove the first blade before moving on to the second and/or third blade. This required moving the nut securing socket from the first nut and placing it on the second nut before the second bolt could be removed. Thus, according to the prior art, multiple steps are required to remove more than one blade from multi-blade mowers.

The prior art includes a wide variety of tools for accommodating multiple fittings. A large number of multiple lug nut devices exist as exemplified by those disclosed in U.S. Pat. Nos. 4,063,475; 5,074,170; and 6,305,245 B1. Further, a double torque wrench, U.S. Pat. No. 6,253,644 B1 and a double screw driver, U.S. Pat. No. 5,218,758 are known.

Further, in the field of heavy machinery, and lawn mowers in particular, many devices have been developed for holding a cutting blade during removal, as exemplified by U.S. Pat. No. 4,564,991. And, Applicant is aware of at least one device, U.S. Pat. No. 5,865,018, for assisting in removing a single blade of a non-commercial grade lawn mower by jamming the tool and blade against the inside of the lawn mower skirt.

A drawback to the tools known in the art is that none is useful in the pertinent field for use in removing more than one nut from a bolt on a lawn mower or other machines and none are flexible enough to accommodate a variety of machines with variously positioned nuts. Thus, there is a need in the art for providing a multiple nut tool for use in removing more than one nut from a bolt and which is movable in relation to the nuts. It, therefore, is an object of the invention to provide a multiple nut tool and method, which is flexible in positioning, for enabling removal of more than one nut from a machine.

SUMMARY OF THE INVENTION

The multiple nut tool and method of the present invention includes a slide shaft. More than one socket receiver is connected to the slide shaft and at least one of the socket receivers is movable. A socket adapter is connected to each of the socket receivers.

In another aspect of the invention, a retainer is attached to the slide shaft. In another aspect, at least one of the socket receivers is stationary. In another aspect, there are two socket receivers.

In another embodiment of the invention, the slide shaft is T-shaped and, in another, the T-shaped slide shaft includes two movably connected slide shafts. In a further embodiment, the T-shaped slide shaft includes at least three socket receivers.

According to another embodiment, a method for retaining and removing multiple nuts using a tool includes the steps of providing a slide shaft and connecting at least two socket receivers to the slide shaft such that at least one of the socket receivers is movably connected to the slide shaft. A socket adapter is connected to the socket receivers and sockets are attached to the socket receivers. A socket is placed on a first nut. A second socket is moved over and placed on a second nut and this step is repeated until all nuts are fitted with sockets. Thereafter, the nuts are loosened while held in place by the sockets.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

An embodiment of the invention is illustrated by way of example in FIGS. 1–4. With specific reference to FIGS. 1 and 2, multiple nut tool apparatus 10, according to an embodiment of the invention, includes a slide shaft 12. More than one socket receiver 14 is connected to the slide shaft 12 such that at least one of the socket receivers 14 is movable.

By way of example only and not by limitation, slide shaft 12 is made of a tubular hollow material, square in shape and preferably of metal. One long piece of square tubular metal forms the slide shaft 12. More than one larger diameter but shorter piece of square tubular metal forms the socket receivers 14. According to one embodiment, at least one of the socket receivers is free to slide back and forth along the length of slide shaft 12 for the purpose of adjusting the distance between blade bolts, as will be more fully disclosed hereafter. Certainly, slide shaft 12 and socket receivers 14 may be any shape, any dimension and/or made of any material sufficient for the purposes of the invention.

Figure 1:
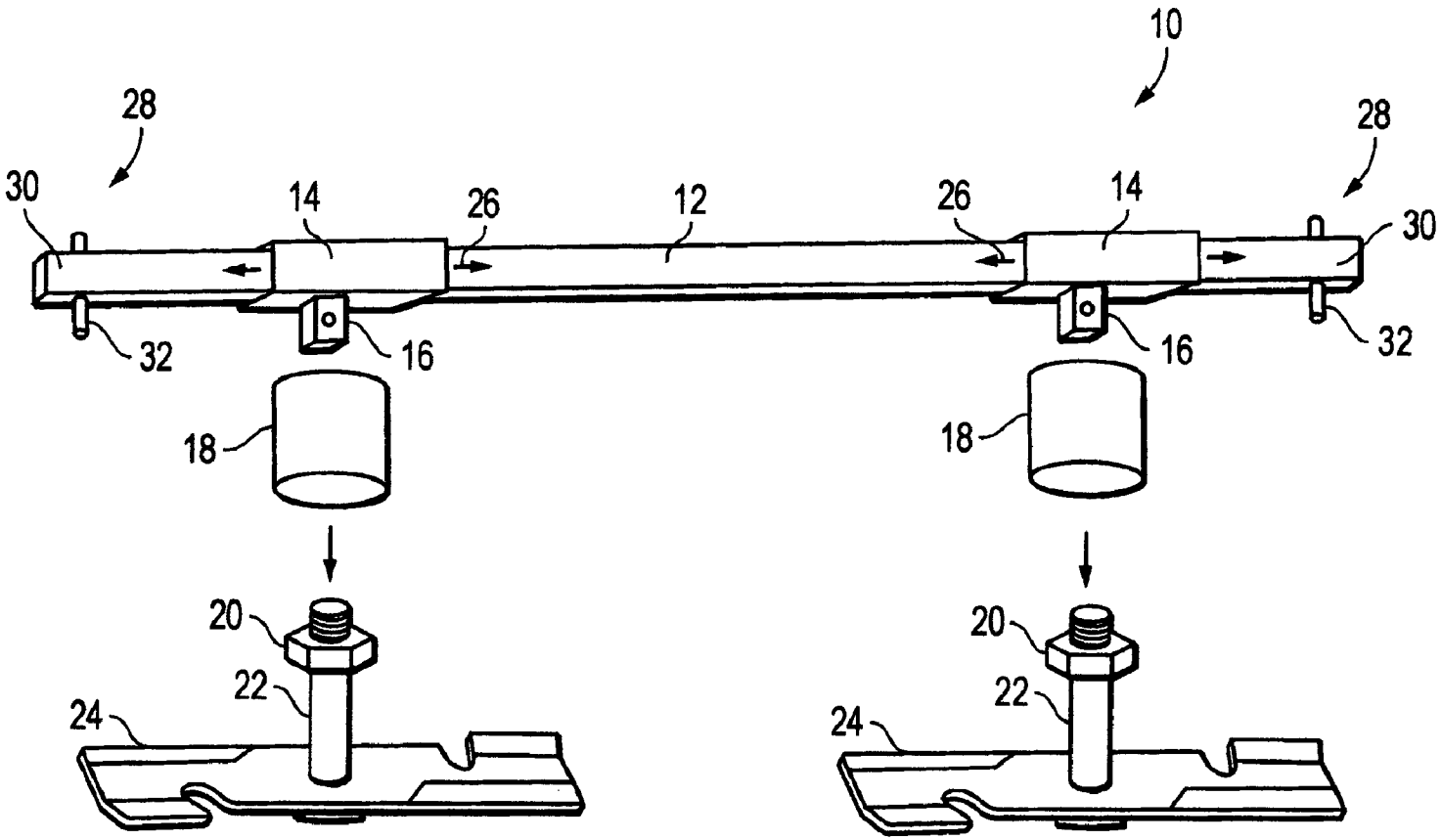
FIG. 1 is a perspective exploded view of the multiple nut tool of the present invention.
Figure 2:
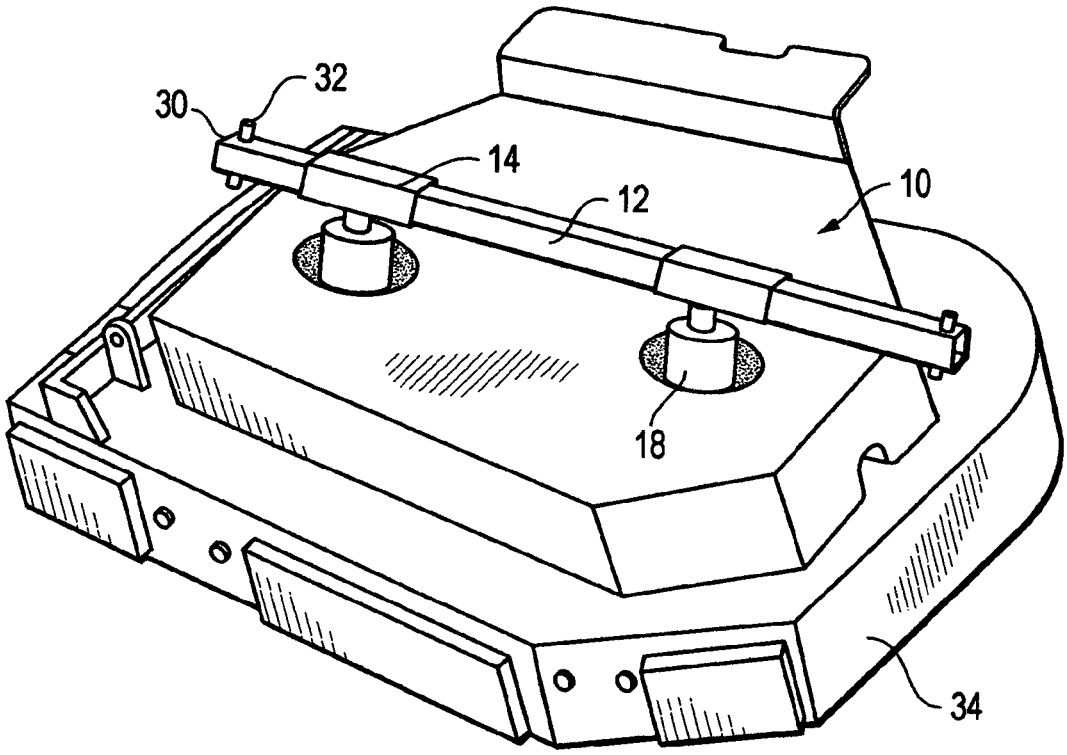
FIG. 2 is a perspective view of the invention of FIG. 1 shown in place on a lawn mower with multiple blades.

Still referring to FIGS. 1 and 2, multiple nut tool 10 also includes a socket adapter 16 connected to each socket receiver 14. Socket adapter 16 connects any size ratcheting socket 18 to the socket receivers 14. Because different machines use different sized nuts 20 and bolts 22 to hold blades 24 in place, for example, different sized sockets 18 may be required.

As shown in FIG. 1, both socket receivers 14 are free to slide/move along slide shaft 12 in any direction as indicated by arrows 26. According to one embodiment, a retainer 28 is connected to the ends 30 of slide shaft 12. By way of example only, and not by limitation, retainer 28 may take the form of a retaining pin 32. Holes are drilled through the ends 30 of slide shaft 12 and retaining pins 32 are set so as to protrude through two sides of slide shaft 12. This feature prevents socket receivers 14 that are movable from slipping off the ends 30 of slide shaft 12. Obviously, any retainer 28 now known or hereafter developed for preventing socket receivers 14 from slipping off the ends 30 of slide shaft 12 is appropriate.

Referring now specifically to FIG. 2, multiple nut tool apparatus 10 is shown in place on a piece of machinery. Applicant's invention is obviously appropriate for use with any type of machinery with multiple nuts, but for the purpose of explanation and not by way of limitation, FIG. 2 shows multiple nut tool apparatus 10 in place on the top portion of a lawn mover 34. In the case where only one of the socket receivers 14 is movable, the non-movable socket receiver 14 is placed on one of the nuts 20 and then the other, movable socket receiver 14 is moved into position over the other nut 20. Once in place, the socket receivers 14, in combination with socket adapters 16 and sockets 16 hold nuts 20 in place against any movement. Thereafter, a common ratchet or wrench is used to loosen the nut 20 by moving bolt 22 (not shown) as is known in the art.

Figure 3:
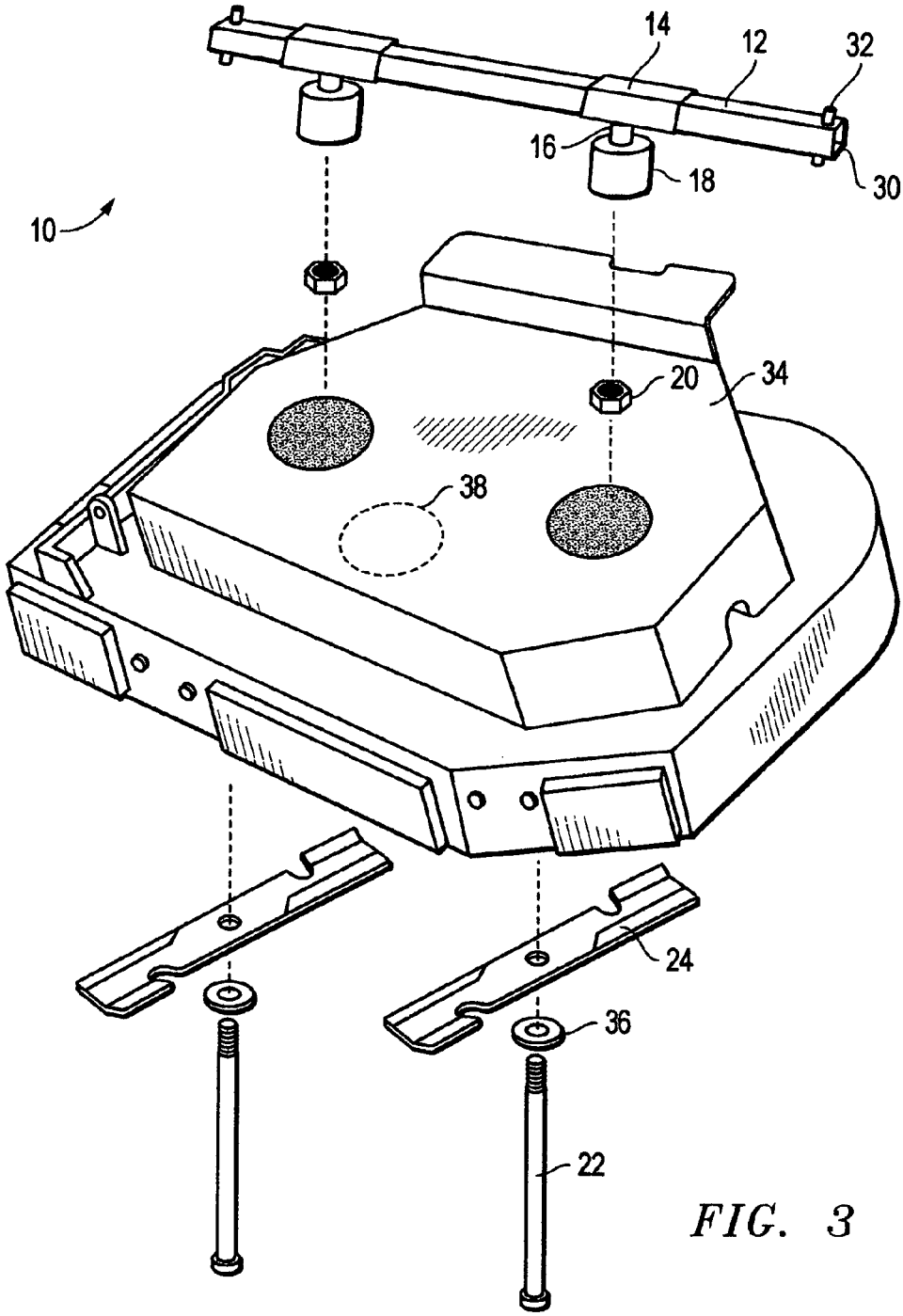
FIG. 3 is an exploded view of the invention as illustrated in FIG. 2.

Referring now to FIG. 3, an exploded view of the elements of the invention just described is illustrated. In this illustration, a locking washer 36 is shown for assisting in keeping long bolt 22 in place.

Figure 4:
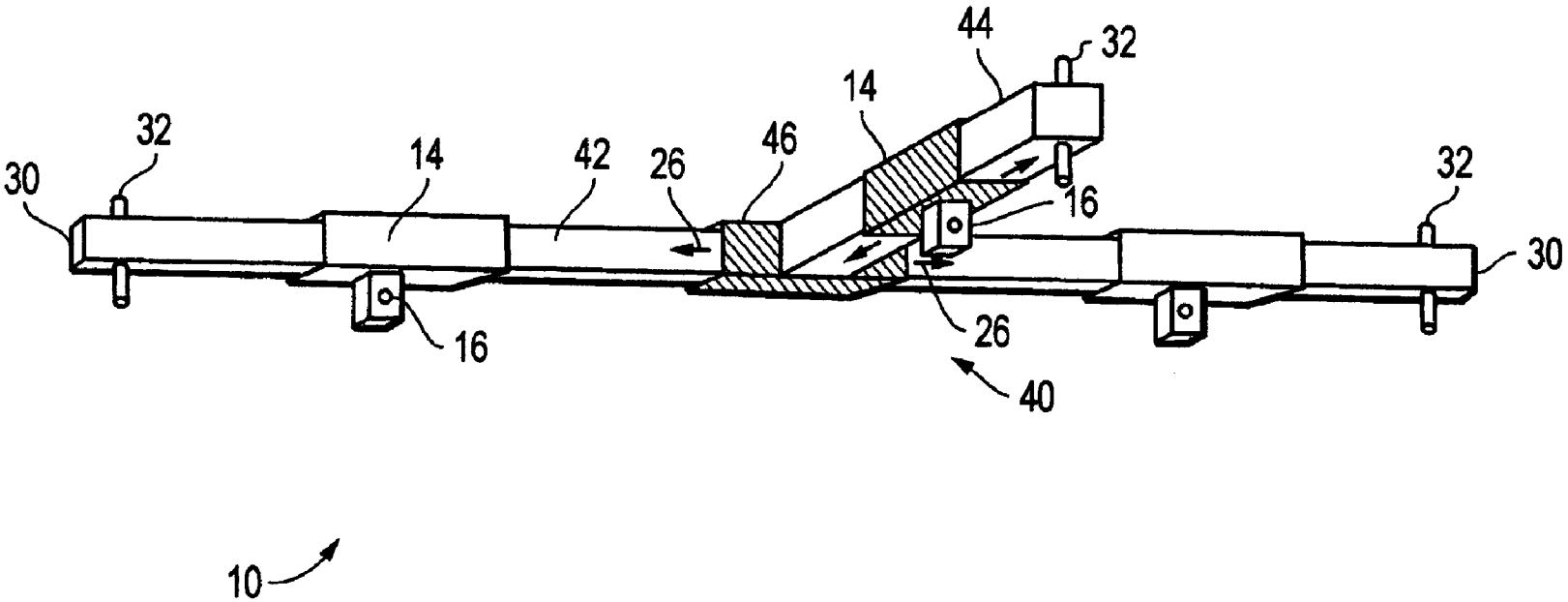
FIG. 4 is a perspective view of another embodiment of the invention.

Also illustrated is another embodiment of lawn mower 34 wherein a third blade mounting position 38 is shown in dotted lines. Many large lawn movers 34, so called "commercial grade" lawn mowers 34, include three or more blade. As such, Applicant's invention as illustrated and disclosed so far is helpful but inadequate for removing more than two nuts 20 at once. FIG. 4 shows another embodiment of the multiple nut tool apparatus 10 in the form of a T-shaped slide shaft 40. T-shaped slide shaft 40 includes two movably connected slide shafts 42 and 44. Slide shaft 42 includes socket receivers 14 and socket adapters 16 as disclosed above, along with retaining pins 32 at ends 30. One or both of the socket receivers 14 are movable along slide shaft 42, also as discussed above. Additionally, however slide shaft slide connector 46 is movably connected to slide shaft 42 and is free to move in the direction of arrows 26 too.

Slide shaft 44 is connected to slide shaft slide connector 46. Slide shaft 44 includes all the elements of the invention including at least one movable socket receiver 14, socket adapter 16 and retaining pin 32. As a result, for lawn mowers 34, for example only, with three nuts, T-shaped slide shaft 40 allows the user to place sockets 18 over the three nuts 20 by moving the socket receivers 14 so as to line up with each of the nuts 20. Again, once in place, multiple nut tool apparatus 10 holds the nuts 20 in place, simultaneously, for removal.

The description of the present embodiments of the invention has been presented for purposes of the illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A multiple nut tool comprising:

a) a T-shaped slide shaft including a pair of movably connected slide shafts;

b) three socket receivers connected to the T-shaped slide shaft wherein at least two of the three socket receivers is movably connected to the T-shaped slide shaft; and c) a socket adapter connected to the three socket receivers.

2. The tool of claim 1 further comprising retainer pins attached to the T-shaped slide shaft.

* * * * *